US007243646B2

(12) United States Patent
Todack

(10) Patent No.: US 7,243,646 B2
(45) Date of Patent: Jul. 17, 2007

(54) APPARATUS AND METHOD FOR SHEARING REINFORCED CONCRETE PILES AND METAL PILES AND CRUSHING REINFORCED CONCRETE PILES

(76) Inventor: James J. Todack, P.O. Box 878, Bacliff, TX (US) 77518

( * ) Notice: Subject to any disclaimer, the term of this patent is extended or adjusted under 35 U.S.C. 154(b) by 127 days.

(21) Appl. No.: 11/073,182

(22) Filed: Mar. 4, 2005

(65) Prior Publication Data

US 2005/0194000 A1 Sep. 8, 2005

Related U.S. Application Data

(60) Provisional application No. 60/550,552, filed on Mar. 5, 2004.

(51) Int. Cl.
*B28D 1/32* (2006.01)

(52) U.S. Cl. ..... 125/23.01; 125/40; 144/4.6; 144/195.1; 83/694; 83/639.5; 83/563

(58) Field of Classification Search ..... 125/12, 125/16.01, 16.03, 23.01, 40; 144/4.6, 34.5, 144/195.1, 366; 83/623, 694
See application file for complete search history.

(56) References Cited

U.S. PATENT DOCUMENTS

| | | | | |
|---|---|---|---|---|
| 2,612,194 | A | 9/1952 | Ingraham et al. | |
| 3,056,267 | A | 10/1962 | McRee | |
| 3,392,719 | A | 7/1968 | Clanton et al. | |
| 3,421,558 | A | 1/1969 | Thompson | |
| 3,886,927 | A * | 6/1975 | Chattin | 125/23.01 |
| 3,937,260 | A | 2/1976 | Anderson | |
| 4,124,015 | A | 11/1978 | Isaksson | |
| 4,197,828 | A | 4/1980 | Schellhorn | |
| 4,261,399 | A * | 4/1981 | Hawkins et al. | 144/34.5 |
| 4,273,171 | A * | 6/1981 | Spaulding, Sr. | 144/195.1 |
| 4,334,562 | A * | 6/1982 | Granlund | 144/195.1 |
| 4,641,694 | A * | 2/1987 | Rohde | 144/4.6 |
| 4,805,676 | A * | 2/1989 | Aikins | 144/4.6 |
| 4,896,574 | A * | 1/1990 | Hull et al. | 83/675 |
| 4,979,489 | A | 12/1990 | Abbasov et al. | |
| 5,139,006 | A | 8/1992 | Trudeau | |
| 5,161,588 | A * | 11/1992 | Hamilton | 144/34.1 |
| 5,245,982 | A * | 9/1993 | Trudeau | 125/12 |
| 5,289,816 | A | 3/1994 | Rakowski | |
| 5,413,086 | A | 5/1995 | Trudeau | |
| 5,557,995 | A | 9/1996 | Robinson | |
| 5,598,754 | A | 2/1997 | Robinson | |
| 6,431,655 | B1 | 8/2002 | Mantovani | |
| 6,626,074 | B1 | 9/2003 | Wheeler | |
| 2006/0169270 | A1 * | 8/2006 | Scherer et al. | 125/23.01 |

* cited by examiner

*Primary Examiner*—Eileen P. Morgan
(74) *Attorney, Agent, or Firm*—Kenneth A. Roddy

(57) ABSTRACT

An apparatus (10) for shearing off reinforced concrete piles and metal piles, casing and conductor pipes, and crushing reinforced concrete piles has a frame (11) with first and second ends and a cutter blade (41) movably mounted on the frame driven by hydraulic rams (21) between a retracted position adjacent to the first end and an extended position toward the second end. An abutment gate (30) pivotally mounted and latched at the frame second end has vertically spaced first and second abutment surfaces (52A, 52B) and first and second horizontal shearing surfaces (53A, 53B) disposed in parallel vertically spaced relation defining an opening (51) therebetween through which the cutting edge (41B, 41C) of the blade passes. Removable crushing attachments (60A, 60B) allow crushing of concrete piles, and removable arcuate abutment attachments (54) accommodate cylindrical piles, casing and conductor pipes.

12 Claims, 9 Drawing Sheets

APPARATUS AND METHOD FOR SHEARING REINFORCED CONCRETE PILES AND METAL PILES AND CRUSHING REINFORCED CONCRETE PILES

CROSS REFERENCE TO RELATED APPLICATION

This application claims priority of U.S. Provisional Patent Application Ser. No. 60/550,552 filed on Mar. 5, 2004.

BACKGROUND OF THE INVENTION

1. Field of the Invention

This invention relates generally to pile cutting and crushing apparatus and methods, and more particularly, to an apparatus and method for shearing reinforced concrete piles, metal piles, casing and conductor pipe arrangements, and crushing reinforced concrete piles to expose reinforcing steel within the piling without damaging the structural integrity of the imbedded steel.

2. Background Art

As used herein, the term "columnar" is defined as resembling or having the form of a column. The term "pile" or "piling", as used herein, means a long columnar member driven or installed into the earth or seabed to carry a vertical load or serve as a support or protection. The present invention has utility in the construction industry for shearing and crushing reinforced concrete piles or pilings, and in the offshore oil and gas well drilling industry for shearing metal piles that are used to anchor and support offshore platforms, and the associated well casing and conductor pipe arrangements, including conductor arrangements having concentric sleeved pipes with grout or cementation in the annulus between adjacent pipes, when decommissioning or demolishing offshore platforms.

In the construction industry, reinforced concrete piles, prefabricated pre-stressed concrete piles, auger bore piles, as well as drill shaft piles are used as vertical supporting members for supporting highway overpasses, bridges, docks and piers. During a demolition or construction contract, the removal of existing piles or pilings or the cutting and/or crushing of newly installed piling to a desired elevation may become necessary to complete a project.

Several common methods for removal of existing pilings of the type used in supporting highway overpasses, bridges, docks and piers include the use of hydraulic vibrators, mechanical crushing jaws, concrete saws, jackhammers and cutting torches and mechanical cutters. These procedures are time consuming and costly.

One method commonly employed involves the contractor saw cutting the perimeter of the pile at a specific elevation, to a depth just beyond the depth of the steel strands imbedded within the pile, usually 2 to 3 inches below the pile surface, and then, breaking the pile off at this point. This method is slow and labor intensive when multiple piles are involved. When the exposure of the steel reinforcing strands or bars (rebar) within the piles is specified, the task of exposing the rebar is typically accomplished by jack hammering and chiseling, which requires extensive man-hours, with potential danger to the operator, depending on the location of the piles, and damage to the steel reinforcing by the jackhammer or chipping tool.

Reinforced concrete piles are also conventionally cut off or demolished using explosives, however, the use of explosives, particularly in demolishing bridge, pier and dock supporting piles, can have serious negative environmental effects encompassing the water environment and the marine life that typically congregate near piles and utilize the structures as a natural habitat.

Several mechanical cutting devices have been designed and patented in the past twenty-five years that employ the use of hydraulic rams to cause the leading edge of a cutting blade to penetrate and sever various materials. Dating as far back as the 1950's, this method was utilized to cut trees for removal as well as severing the tree into usable lengths.

More recently, this basic design has been employed for the purpose of cutting concrete piles. For example Trudeau, U.S. Pat. No. 5,139,006, discloses a hydraulic pile cutter apparatus and method. In a single blade embodiment, the apparatus is leveled about the pile to be cut, and the blade is pushed through the reinforced concrete pile until it nearly reaches an opposed stationary plate to sever the top of the pile, including the reinforcements. In a double blade embodiment having a fixed blade opposed to a coplanar movable blade, both blades have cutting edges formed to fit around the pile, and the double blades shear the concrete of the pile leaving the reinforcement intact. Projecting vertical angle iron attachments for shattering the concrete above the common plane and recessed attachments for pile guiding are also disclosed.

Trudeau, U.S. Pat. No. 5,245,982, discloses a hydraulic concrete pile cutter apparatus and method which utilizes a single blade with a beveled cutting edge which confronts a stationary anvil plate having a substantially flat abutment face supporting a concrete pile on the side opposite the blade. The blade has a substantially straight cutting edge and is driven through the pile to crack the concrete matrix of the pile and into edge-to-face engagement with the abutment face of the anvil throughout the length of the cutting edge to sever the reinforcement strands. The blade may be provided with a wedge-shaped cutting edge wherein driving the blade into the concrete matrix of the pile wedges the matrix apart at the selected position. An alternative anvil may be mounted on the anvil gate, which includes a back plate with an abutment face for supporting the pile at the cut-off location and against which the blade engages when fully extended. The alternative anvil also includes two supports above and below the abutment face, each consisting of two wedge-shaped elements projecting from the face of the plate to form angular support surfaces that match and support three adjacent faces of a hexagonal pile, such that of the six corners on the hexagonal pile, four are supported by the anvil and the other two are at edges of the pile that is first engaged with the cutting blade.

Trudeau, U.S. Pat. No. 5,413,086, discloses a method and apparatus for preparing an end of a reinforced concrete pile which utilizes a shear blade having a straight cutting edge to sever the top of a pile supported on the flat abutment surface of a stationary anvil plate opposite the blade. Once the top of the pile has been cut off, the shear blade and anvil are replaced with a pair of coplanar blades each having a cutting edge that matches the profile of one-half of the pile for removing the concrete matrix from the reinforcement strands down to a certain level below the cutoff position. The coplanar blades engage the surface of the pile and penetrate the surface while wedging the upper part of the pile up away from the main body of the pile to crack the concrete through at the desired position. At the same time, upright angle iron concrete breaker attachments mounted on the blades engage the concrete pile above the blades to fracture the concrete from the reinforcing steel.

The above noted patents employ a "blade and anvil method" for severing the pile and reinforcement strands which utilizes a straight cutting blade having a beveled cutting edge to sever the piling by forcing the straight cutting edge of the cutting blade through the pile until it is in full "edge-to-face" contact with the opposing flat anvil surface, thus severing the piling and the structural steel reinforcing therein between the blade edge and the face of the abutment/anvil surface. The above noted patents also teach replacing the shearing blade and anvil with a pair of coplanar blades each having a cutting edge that matches the profile of one-half of the pile that engage the surface of polygonal piles and penetrate the surface while wedging the upper part of the pile up away from the main body of the pile to crack the concrete through at the desired position, and fracture the concrete from the reinforcing steel with concrete breakers mounted on the blades.

The prior art blade and anvil "edge-to-face" cutting method and pile crushing method, such as described in the above patents, have several drawbacks. The blade and anvil "edge-to-face" method requires that the straight cutting blade edge make full and complete contact with the face of the anvil surface to complete the cut. As the straight beveled edge of the cutting blade becomes worn, it prevents the leading edge of the blade from making complete contact with the anvil face, thus potentially preventing the leading edge of the blade from completely severing all the steel strands and/or rebar. One of the problems with the prior art pile crushing method, such as taught by these patents, is that it requires the removal of the shearing blade and the anvil abutment plate and the installation of a pair of opposed coplanar blades each having a cutting edge that matches the profile of one-half of the pile; thus, different sizes of coplanar blades would be required for crushing various different sizes and shapes of piles to achieve the desired result.

In the offshore oil and gas well drilling industry, offshore marine structures or platforms are supported on and anchored to the ocean floor by "piles" which are hollow casings or pipes driven into the sea bed. These offshore structures typically include "casing" or "conductor" arrangements that extend from deep into the sea floor up to the production deck of the offshore structure which are used in drilling and as conduits to carry petroleum and gas from a reservoir deep within the earth to a gathering and process location on the offshore structure above the sea floor and also above the surface of the sea. These casing or conductor arrangements are typically composed of several concentric sleeved pipes of increasing diameters with the space between the side walls of the pipes being filled with grout or reinforcing cementation.

When the wells serviced by the platform run dry, the offshore platforms must be "decommissioned" or removed and appropriately disposed of. Current regulations require that when removing an offshore platform, all structural elements of the platform and all well conductors (both the piles and conductors) must be removed down to a depth of at least 15 feet below the mud line so that no projections are left which could pose a navigational hazard or present an obstacle to mariners, unless a special exception is granted. The principal basis for an exception is using the platform in a rigs-to-reefs program administered by the state of Louisiana or Texas, whereby some platforms are deposited at designated sites to provide a habitat for reef fish that are valued by recreational and commercial fishermen.

Current methods for decommissioning or removing offshore platforms include the use of mechanical cutters, such as saws and water jet cutters driven from the surface, and explosives. However, conventional mechanical cutting procedures are time consuming and expensive. If there is concrete or grout between the casing and conductor or in the annulus between the pipes, the cutting is slowed down and the cutter may not work efficiently.

In a typical conventional mechanical cutting operation, a cutting tool is placed inside of the casing and/or conductor and is rotated to make the cut from inside the casing. When the first inside casing is removed, another cutter with a greater diameter is placed inside of the conductor and it is cut in the same manner as the casing. If there is concrete or grout between the casing and conductor or in the annuals formed by the two pipes, the cutter may not function properly. If the casing cannot be cut from the inside, it must be cut from the outside. When cutting the casing and conductor or pile to a depth of at least fifteen-feet below the sea floor, a hole must be excavated around the casing and conductor or pile to allow a diver to enter into the excavation with sufficient room to cut the casing and conductor or pile off. The conventional mechanical cutting operations and use of divers is time consuming, expensive, and dangerous to the divers.

The use of explosives is often used for the removal of grouted well conductors or grouted piles, however, this technique can have serious deleterious environmental effects encompassing the marine environment and the living marine resources, such as sea turtles, marine mammals, and fish, that typically congregate near the platform and utilize the platform as a natural habitat.

European Patent EP 0243981 discloses a method and a cutting tool for cutting-off an elongate marine platform pile made up of steel cylinders filled with concrete and located one inside the other. The apparatus has a frame and a cutting blade slidably mounted thereon which is moved by hydraulic cylinders toward a counterpiece which may be fixed to the frame in opposed relation to the blade in a plane below the plane of the cutter blade, or may be pivotally mounted on the frame. As viewed from the top, the blade has a wide V-shaped leading edge. As seen from the side, the upper face of the blade consists of two inclined planes that intersect at the edge of the blade, and the bottom surface of the blade is horizontal. The cutting blade is pressed against the pile, which is supported against the counterpiece. A cutting force is directed at the pile by means of the cutting edge of the blade, which has a larger blade angle (larger than 45°, preferably 65° to 75° with respect to a horizontal plane), and a bending force is directed at the pile by means of a wedge effect of the smaller inclination angle (smaller than 45°, preferably about 30° to 40° with respect to a horizontal plane). A crack is formed in the pile in front of the blade edge, and the pile is broken by the bending moment. The wide V-shaped edge causes a shearing effect to be directed at the pile first at two points, and as cutting continues, the sides of the pile are cut before the middle part of the pile. In this device the blade tends to move upwards when the cutting is started and, to prevent breaking the frame, the face of the counterpiece is mounted at a small angle (about 1° to 5° with respect to a vertical plane) such that the counterpiece can turn downwards while the blade is rising.

The present invention overcomes the several disadvantages, drawbacks or deficiencies of the prior art reinforced concrete pile cutting and crushing apparatus and methods in that it provides an apparatus and method that employs a "shearing method" to cut concrete piles containing reinforcement steel, wherein the leading edge of the movable cutting blade does not make contact with the anvil face or surface, as opposed to the blunt edge-to-face "blade and anvil" cutting method of the prior art. The present invention also employs a concrete pile crushing method that does not require the removal of the primary cutting blade, as required in prior art methods, but instead, utilizes the same cutting blade that was used in the shearing operation for the crushing operation with the addition of a set of crushing attachments. Any size piling that can be cut by the shearing operation can be crushed with the addition of the crushing attachments Thus, the present pile cutting and crushing apparatus and method requires less servicing time when converting from the cutting operation to the crushing operation, and eliminates the need for several sizes of crushing jaws. The present crushing apparatus and method also crushes concrete material surrounding the reinforcing steel in the piling to expose the steel reinforcing within, without damaging the integrity of the structural steel within the pile.

The present invention also overcomes the several disadvantages, drawbacks or deficiencies of the prior art devices that cut metal pipe and piles used to support offshore platforms, and the associated casing and concentric conductor pipe arrangements, in that it provides an apparatus and method that employs a balanced shearing action to cut the metal members wherein one side of the metal pile is supported against a pair of vertically spaced stationary abutment surfaces and shearing surfaces in a plane above and below the plane of the leading edge the cutter blade and the leading edge of the cutting blade passes horizontally through the metal pile and continues through the vertically spaced abutment surfaces and shearing surfaces, thereby significantly reducing ovate distortion of the pile, the tendency of the blade to rise or move upwards or downwards during cutting and the resultant offset stress forces on the frame and blade.

Removable crushing attachments allow the same frame and blade apparatus used for the shearing operation to be used for crushing reinforced concrete piles, and removable concave abutment attachments adapt the apparatus to accommodate cylindrical piles, casing, tubing and conductor pipes, and significantly reduces ovate deformation during the shearing operation.

SUMMARY OF THE INVENTION

It is therefore an object of the present invention to provide an apparatus and method for shearing columnar members that has utility in the construction industry for shearing and crushing reinforced concrete piles or pilings, and in the offshore oil and gas well drilling industry for shearing metal piles that are used to anchor and support offshore platforms, and the associated well casing and conductor pipe arrangements, when the platform is to be decommissioned.

It is another object of this invention to provide an apparatus and method for shearing and crushing reinforced concrete piles when demolishing bridges, overpasses, docks, and piers, and shearing metal piles, casing, and conductor pipes, when decommissioning offshore platforms, that does not have a detrimental effect on the environment or marine life, as explosives do.

Another object of this invention is to provide an apparatus and method for shearing or crushing reinforced concrete piles, and shearing metal piles, casing, and conductor pipes, to a specific elevation for the purpose of removal or for future build out.

Another object of this invention is to provide an apparatus and method for shearing reinforced concrete piles that employs a "shearing" method to cut concrete piling containing reinforcement steel, as opposed to a blunt blade and anvil "edge-to-face" cutting method.

Another object of this invention is to provide an apparatus and method for shearing and crushing reinforced concrete piles that crushes the concrete material surrounding the reinforcing steel in the pile to expose the steel reinforcing within, without damaging the integrity of the structural steel within the pile so that it may be used to anchor additional structures.

Another object of this invention is to provide an apparatus for shearing and crushing reinforced concrete piles that does not require the removal of the cutter blade to carry out the crushing operation.

Another object of this invention is to provide an apparatus and method for shearing reinforced concrete piles to expose the steel reinforcing that utilizes the same movable cutter blade as used in the shearing process equipped with crushing attachments that are easily and quickly attached to the cutter blade and pile abutment surfaces.

Another object of this invention is to provide an apparatus and method for shearing and crushing columnar members wherein the same apparatus can be quickly and easily converted for use to shear either reinforced concrete piles or metal piles and can be used on land and above or below water.

Another object of this invention is to provide an apparatus for shearing and crushing columnar members wherein the apparatus can be quickly and easily installed laterally onto the member to be sheared or crushed.

A further object of this invention is to provide a pile shearing apparatus and method that employs a pair of stationary vertically spaced abutment surfaces defining an opening therebetween with shearing surfaces at the top and bottom of the opening in a plane above and below the plane of the leading edge of an opposed extendable cutter blade so as to receive the leading edge of the cutter blade and create a shearing action to cut the pile and sever reinforcing steel strands or rebar as the cutting blade passes therethrough in reaching its full extended stroke.

A still further object of this invention is to provide a pile shearing and crushing apparatus and method that requires fewer components and less servicing time than prior art apparatus and methods, and is simple in construction, inexpensive to manufacture, and rugged and reliable in operation.

Other objects of the invention will become apparent from time to time throughout the specification and claims as hereinafter related.

The above noted objects and other objects of the invention are accomplished by the present apparatus and method for shearing off reinforced concrete piles and metal piles, casing and conductor pipes, and crushing reinforced concrete piles. The apparatus has a frame with first and second ends and a cutter blade having a cutting edge with a double beveled profile movably mounted on the frame for movement therealong between a retracted position adjacent to the frame first end and an extended position toward the second end. An abutment gate pivotally mounted and releasably latched at the second end of the frame has first and second stationary shearing blades with abutment surfaces disposed in vertically spaced relation defining an opening therebetween and shearing surfaces above and below the opening disposed in planes above and below the cutter blade. Hydraulic rams on the frame move the cutter blade from its retracted position to an extended with its cutting edge extending into the opening between the vertically spaced shearing blades.

In the cutting or shearing operation, the cutter blade is positioned on one side of the pile and oriented transversely of the pile, and the abutment gate is positioned at the opposite side of the pile from the cutter blade, with the vertically spaced abutment surfaces engaging the pile. The rams drive the cutter blade through the pile from one side while it is supported by the abutment surfaces on the opposite side to shear the pile. Removable concave abutment attachments adapt the apparatus to accommodate cylindrical piles, casing, tubing and conductor pipes, and significantly reduces ovate deformation during the shearing operation. When used on reinforced concrete pile, the cutter blade fractures the concrete matrix of the pile, and continues through the pile to sever the concrete and metal reinforcing strands embedded therein and completes the cut by the cutting edge being driven into the opening between the vertically spaced shearing surfaces to shear any remaining reinforcement strands.

In a concrete crushing operation, a first crusher attachment is mounted on the cutter blade and a second crusher attachment is mounted on the abutment gate. The second crusher attachment has a fracturing blade and both attachments have abutment surfaces and a set of replaceable vertical crusher elements protruding from the abutment surfaces spaced a distance from the cutting edge of the cutter blade and the fracturing blade to prevent the blades from engaging the reinforcing strands embedded in the concrete matrix. The cutter blade is driven partially into the pile from one side while it is engaged on the fracturing blade at the opposite side such that the opposed cutter blade and fracturing blade score and fracture the concrete matrix above the opposed blades and continues until the vertical crushing elements and abutment surfaces of the crushing attachments crush the fractured concrete matrix and are stopped by the abutment surfaces without the cutter blade and fracturing blade touching the reinforcing strands. Thus, the reinforcing strands are exposed, without damaging the integrity of the structural steel within the pile.

DESCRIPTION OF THE PREFERRED EMBODIMENTS

Figure 1:
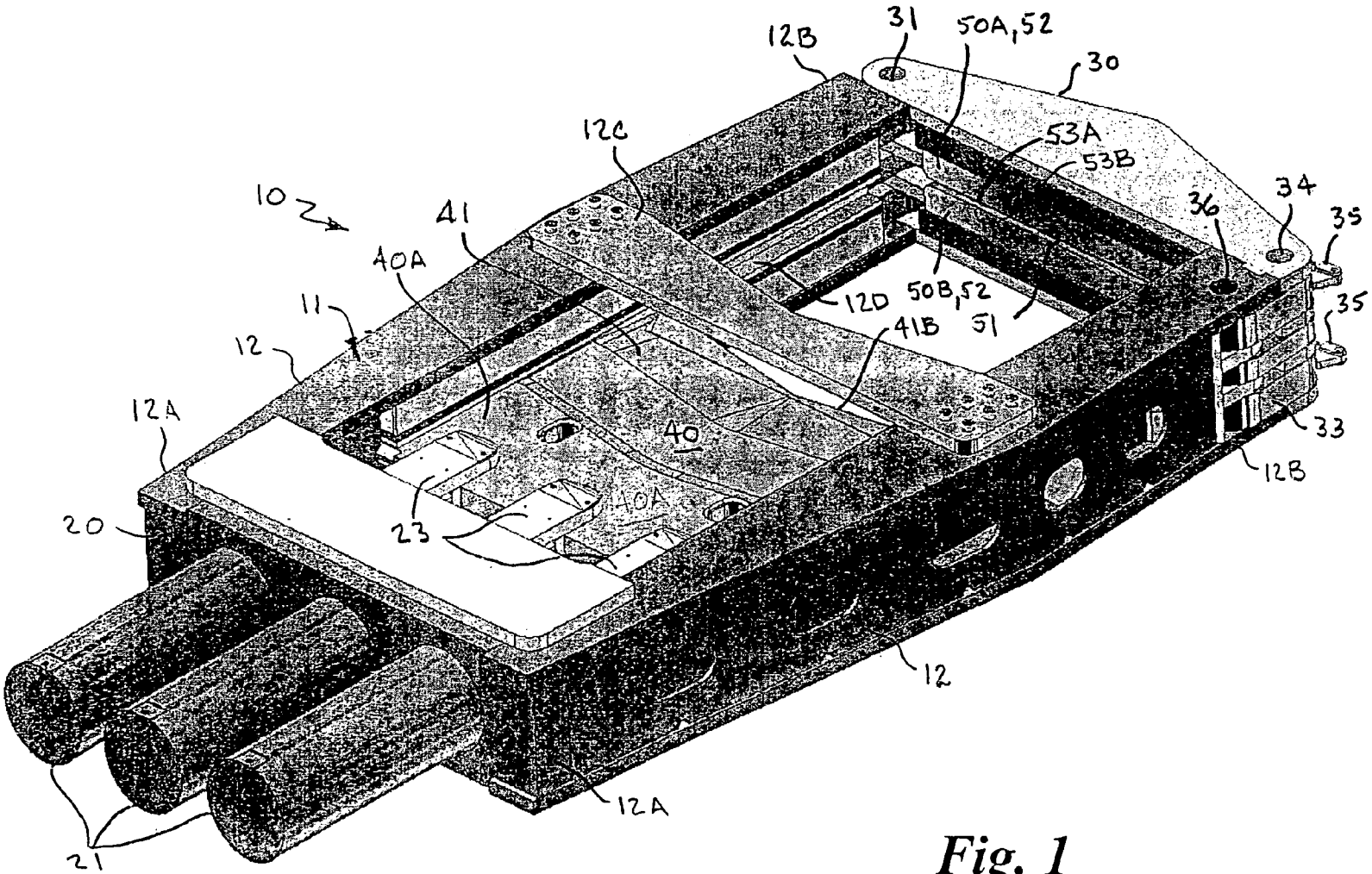
FIG. 1 is a perspective view of the apparatus for shearing concrete and metal piles and crushing reinforced concrete piles in accordance with the present invention, with the two-part cutter blade assembly carrying a cutting blade having a concave leading edge shown in a retracted position and the abutment gate in a closed and latched position.

Referring to the drawings by numerals of reference, there is shown in FIGS. 1-5, a preferred apparatus 10 for shearing a reinforced concrete pile and the reinforcing steel strands or rebar embedded therein at a predetermined height. The apparatus includes a frame 11 having two parallel laterally spaced apart channel members 12 having opposed first and second ends 12A and 12B, a hydraulic ram support cross member 20 extending transversely between the first ends 12A, an abutment gate member 30 hingedly connected at the second ends 12B to extend transversely therebetween in a closed position, and intermediate channel support cross members 12C extending transversely between the channel members 12 intermediate the fist and second ends thereof.

Figure 6:
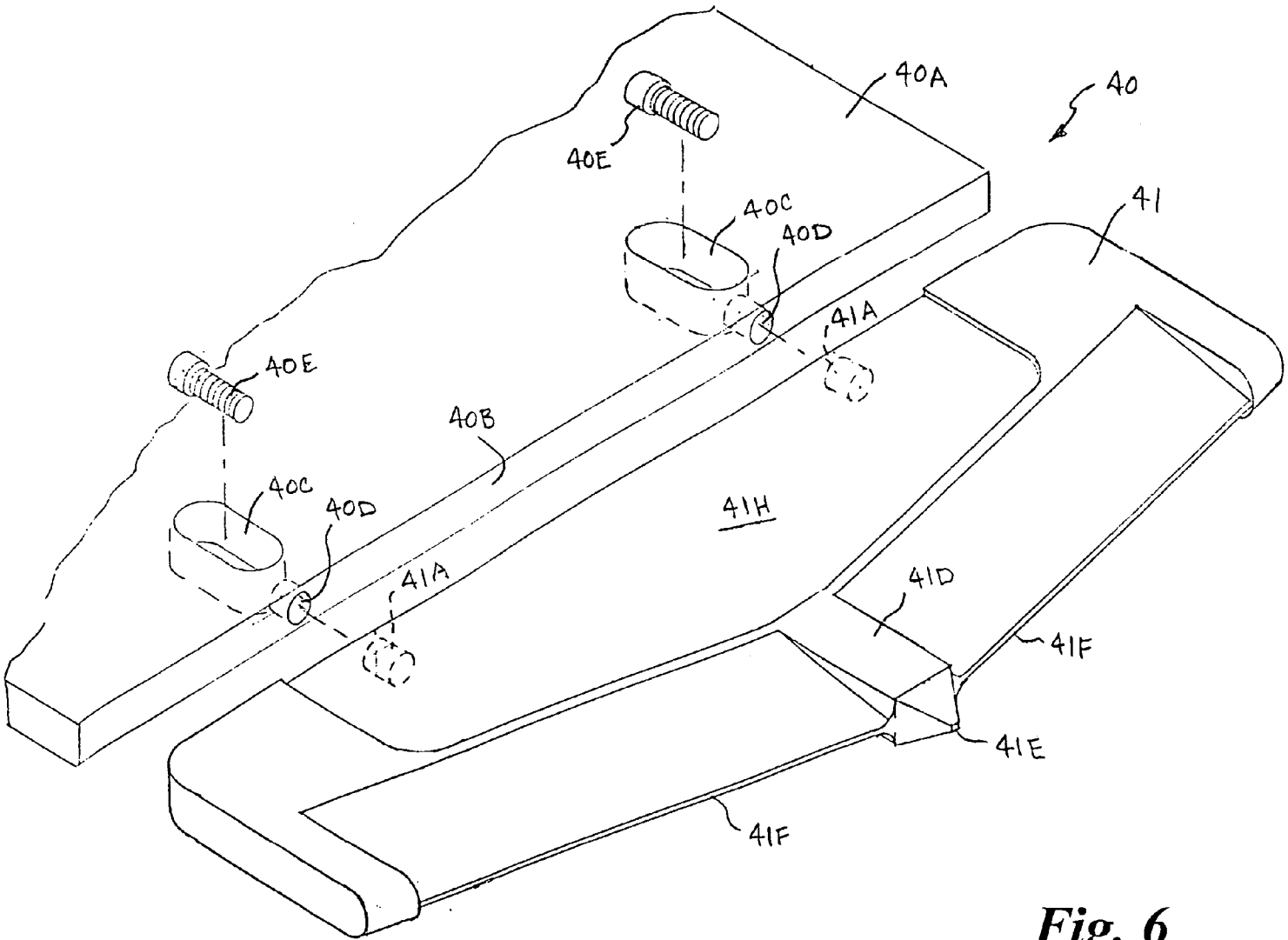
FIG. 6 is an exploded isometric view of a portion of the cutter blade carrier and an embodiment of a cutter blade having an outwardly angled leading edge and a penetrating tip.

A movable two-part cutter blade assembly 40 is slidably mounted transversely between the channel members 12 in guide rails 12D secured to the channel members and is slidable therein between a first or retracted position and a second or extended position. Referring additionally to FIG. 6, the two-part cutter blade assembly 40 includes a blade carrier member 40A and a replaceable cutter blade 41. The blade carrier 40A is a generally rectangular plate approximately 3" in thickness having a front surface 40B and a pair of laterally spaced vertical apertures 40C formed therethrough a short distance from the front surface. A pair of laterally spaced bores 40D extend forwardly from the apertures 40C to the front surface 40B, respectively. The back end of the cutter blade 41 is approximately the same thickness as the front surface 40B of the blade carrier 40A and has a pair of laterally spaced threaded bores 41A extending horizontally in axial alignment with the bore 40D of the carrier. The cutter blade 41 is removably secured to the blade carrier 40A by Allen head bolts 40E received in the apertures 40C and installed through the bores 40D and threadedly engaged in the threaded bores 41A, with the bolt head accessible through the vertical apertures for installation and removal. Several interchangeable cutter blades 41 may be provided that have various different leading edge configurations depending upon the particular application and materials to be sheared.

Figure 4:
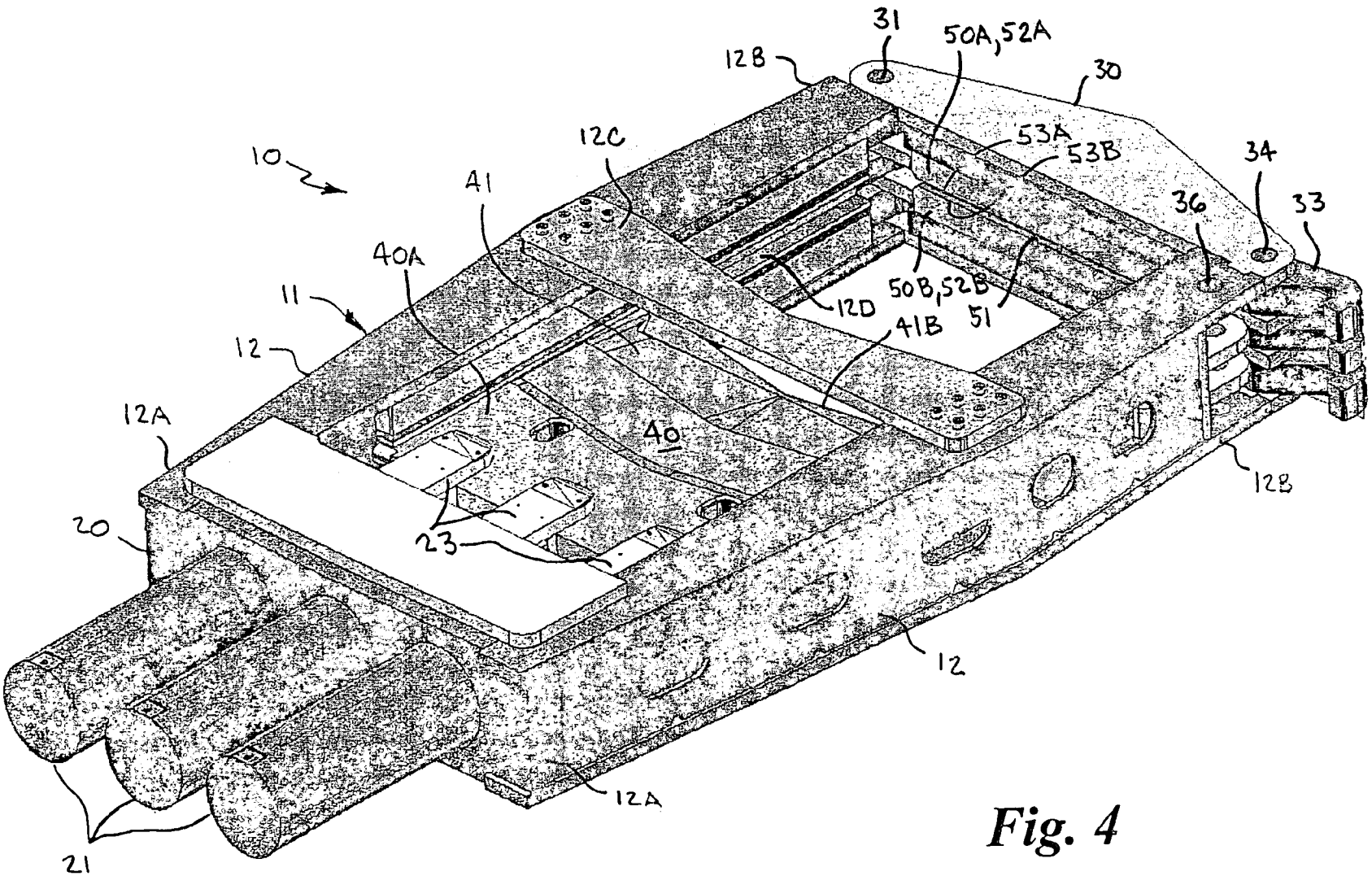
FIG. 4 is a perspective view of the apparatus for shearing concrete and metal piles and crushing reinforced concrete piles, shown with the two-part cutter blade assembly retracted and the abutment gate in a closed position with the latch in an unlatched position.
Figure 5:
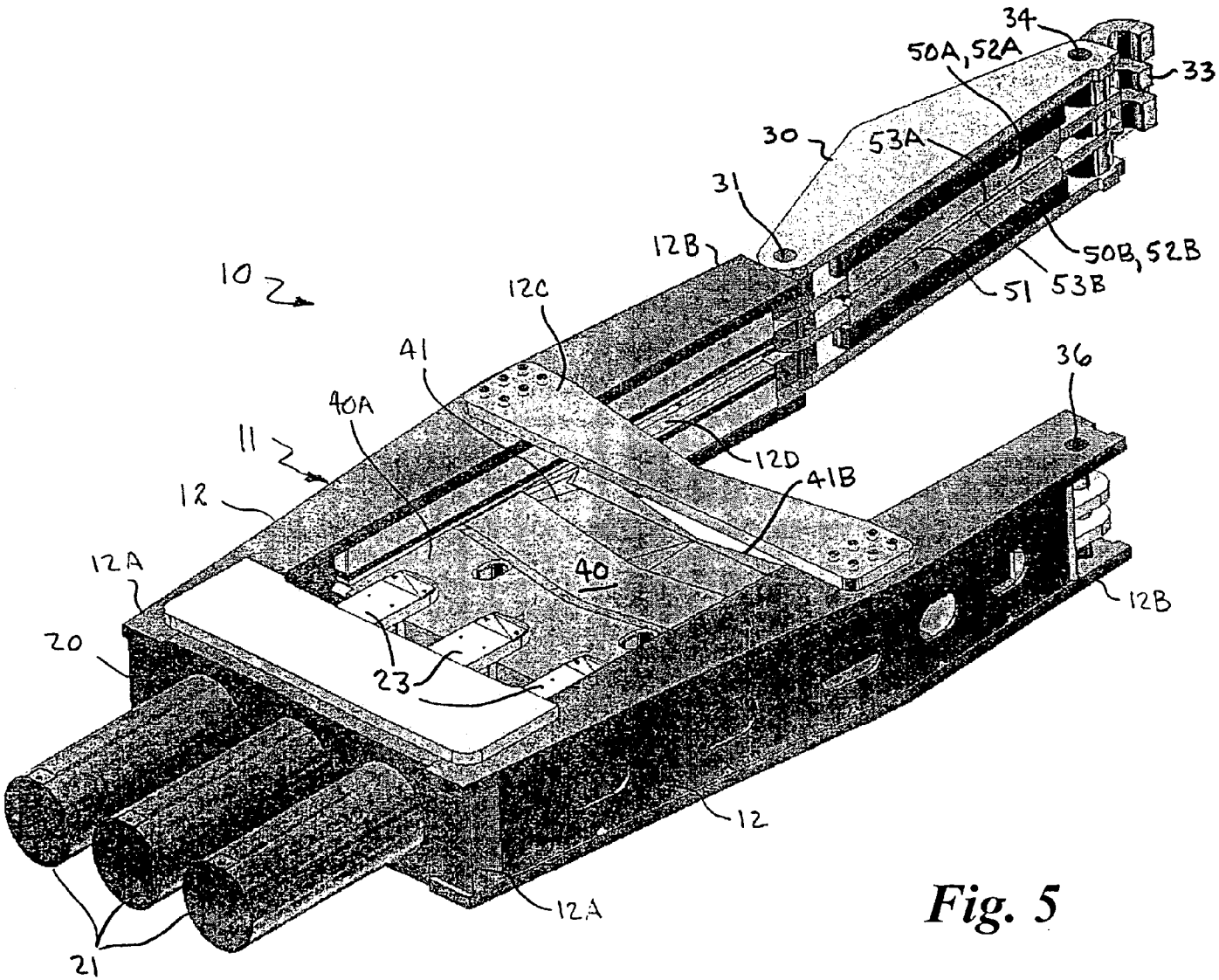
FIG. 5 is a perspective view of the apparatus for shearing concrete and metal piles and crushing reinforced concrete piles, shown with the two-part cutter blade assembly retracted and the abutment gate in a pivoted open position with the latch in an unlatched position.

In the example illustrated in FIGS. 1, 4 and 5, as seen from the top, the front end or leading edge 41B of the cutter blade 41 is shown diverging inward from its lateral sides in opposed relation to form a wide, relatively shallow, V-shaped configuration, and as seen from the side, has a double beveled cutting edge profile formed at an acute angle. In the example illustrated in FIGS. 2 and 3, as seen from the top, the cutter blade 41 has a front end or leading edge 41C that extends straight between its opposed lateral sides and as seen from the side, has a double beveled cutting edge profile formed at an acute angle.

In the example shown in FIG. 6, the cutter blade 41 has thicker relatively narrow central portion 41D that extends a distance forward from the rear portion of the blade and has four sides that converge to form a wedge-shaped penetrating tip 41E, and has an acute angle double beveled leading edge 41F that converges angularly forward from opposed lateral sides and adjoins the converging sides of the wedge-shaped penetrating tip a short distance rearward from its front end. In the example illustrated in FIG. 7, the cutter blade 41 has an acute angle double beveled leading edge 41G that extends straight forward from opposed lateral sides and adjoins the converging sides of the wedge-shaped penetrating tip 41E a short distance rearward from its front end. The top and bottom surfaces at the rear portion of the of the cutter blade 41 may be provided with relatively large shallow recessed areas 41H to reduce the surface area in contact with the material being sheared as the blade passes through the material, and thereby reduce frictional engagement and drag. This type of blade is suitable for penetrating and shearing off reinforced concrete piles and also metal piles, casing, and conductor pipes, as described hereinafter.

The leading or cutting edge of each style of cutter blade and penetrating tip has Rockwell C hardness sufficient to sever concrete, reinforcing steel strands or bars within the concrete, and metal piles, casing and conductor pipes. The hardness limits may apply to the entire cutter blade, or may be limited to the effective cutting edge and penetrating tip.

Hydraulic rams 21 are secured in the hydraulic ram support cross member 20 with their cylinder rods 22 connected by devises 23 to the back end of the cutter blade assembly 40 to move the cutter blade 41 between its retracted and extended positions. In a preferred embodiment, three hydraulic rams 21 are used to provide a high, uniform pressure, resulting in the cutter blade 41 having less potential for jamming.

Figure 2:
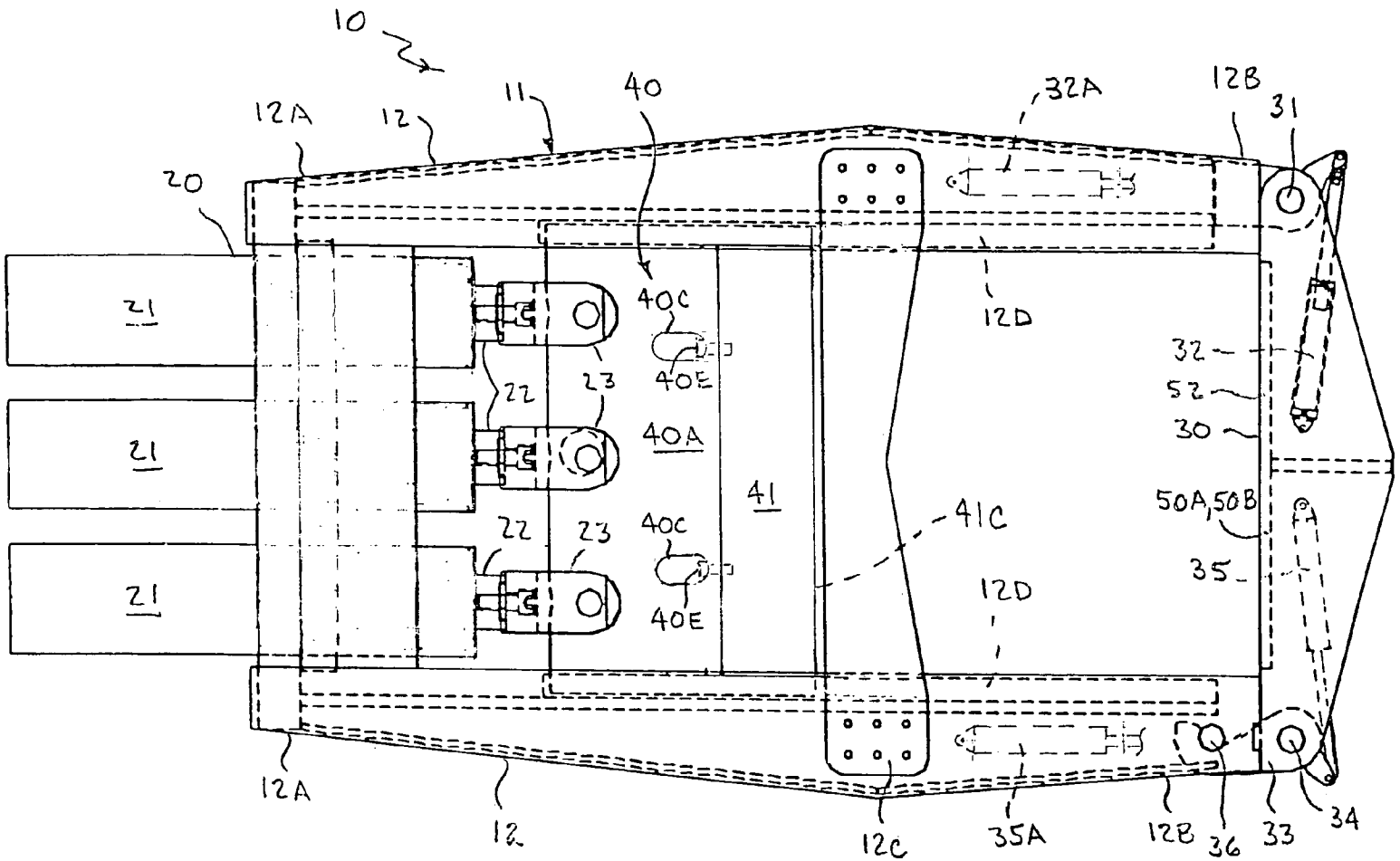
FIG. 2 is a top plan view of the apparatus for shearing concrete and metal piles and crushing reinforced concrete piles, with the two-part cutter blade assembly carrying a cutting blade having a straight leading edge shown in a retracted position and the abutment gate in the closed and latched position.
Figure 3:
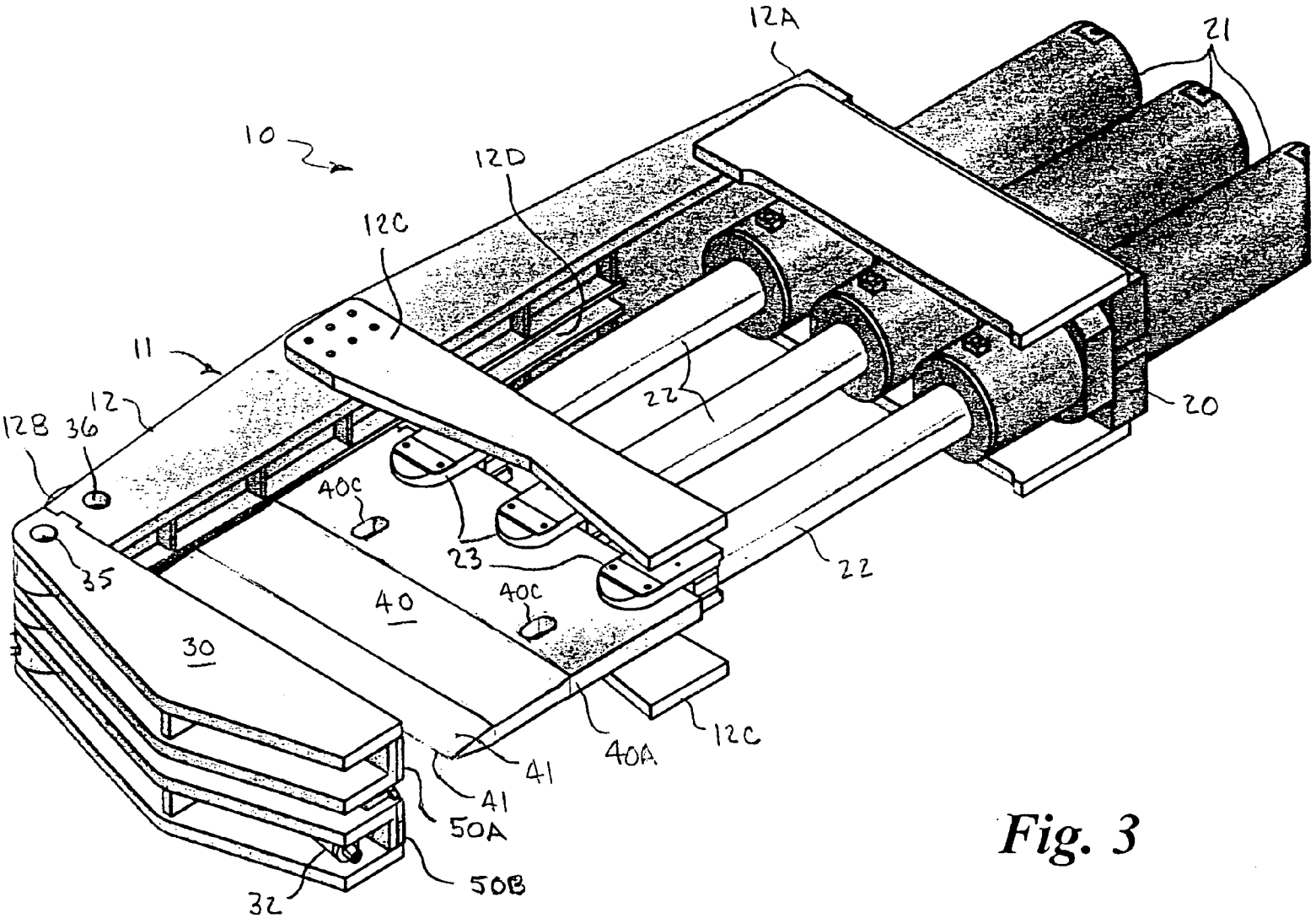
FIG. 3 is a perspective view of the apparatus for shearing concrete and metal piles and crushing reinforced concrete piles, with one side of the frame removed and the two-part cutter blade assembly carrying a cutting blade having a straight leading edge shown in a partially extended position.

One side of the abutment gate 30 is hinged to the second end 12B of one channel member 12 by a removable hinge pin 31 extending through aligned holes in the channel member and the side of the abutment gate. As best seen in FIGS. 2 and 5, the abutment gate 30 is pivoted between an open and closed position by a pair of vertically spaced hydraulic rams 32 operatively connected between one of the channel members and the gate. The opposed side of the abutment gate 30 is provided with a pivoting latch member 33 which is pivotally connected thereto by a pivot pin 34 and is moved by a pair of vertically spaced hydraulic rams 35 carried on the gate between an unlatched position (FIG. 4) and a latched position engaged on a latch pin 36 extending through aligned holes in the second channel member. Thus, the abutment gate 30 is pivoted between an open position (FIG. 5) allowing the apparatus to be received on a piling to be cut or crushed, and a closed and latched position allowing the apparatus to securely embrace the piling during the cutting and/or crushing operation. Alternatively, as indicated in dashed line and represented by numerals 32A and 35A in FIG. 2, the gate pivoting rams and latching rams may be mounted on the channel members 12, rather than on the gate 30.

A first and a second stationary shearing blade 50A and 50B are secured in the hinged abutment gate 30 in vertically spaced relation defining an opening 51 with the vertically opposed surfaces of the shearing blades defining the upper and lower perimeters of the opening. The outer facing vertical surfaces of the stationary shearing blades 50A and 50B serve as abutment surfaces 52A and 52B to engage the piling to be cut or crushed. The vertically opposed bottom and top surfaces of the shearing blades define first and second flat horizontal shearing surfaces 53A and 53B that are disposed in horizontal planes above and below the planes of the top and bottom surfaces of the opposed cutter blade 41 and its leading edge 41B or 41C so as to receive the leading edge and create a shearing action to cut and sever the reinforcing steel strands or rebar as the cutter blade assembly reaches its full extended stroke. The shearing blades 50A and 50B are preferably formed of case hardened steel. The opening 51 between the stationary shearing blades 50A and 50B extends completely through the body of the abutment gate 30 whereby any rubble accumulated in the opening during the cutting process is forced out the back of the opening.

Thus, it should be understood that the leading edge 41B or 41C of the cutter blade 41 has an overall thickness just slightly less than the opening 51 between the stationary shearing blades 50A and 50B in the abutment gate, thus allowing the leading edge to protrude into the opening as it is extended. As the leading edge 41B or 41C passes into the opening 51, the clearance between the top and bottom surfaces of the beveled leading edge and the shearing surfaces 53A and 53B at the top and bottom of the opening decreases.

In its fully retracted position the movable cutter blade 40 is disposed between the hydraulic ram support cross member 20 and the intermediate channel support cross members 12C. In its fully extended position the leading edge 41B or 41C of the cutter blade 41 extends through the opening 51 between the stationary shearing blades 50A and 50B in the abutment gate 30, creating a severing action between the leading edge of the cutter blade and the stationary shearing surfaces 53A and 53B in the abutment gate. With the blade embodiment of FIGS. 6 and 7, the leading edge 41F or 41G and penetrating tip 41E of the cutter blade 41 extend through the opening 51 between the stationary shearing blades 50A and 50B in the abutment gate 30, creating a severing action between the stationary shearing surfaces 53A and 53B in the abutment gate and the top and bottom surfaces of the leading edge and penetrating tip of the cutter blade.

As would be appreciated by those skilled in the art, the dimensions of the abutment gate 30 is not critical as long as it is of sufficient strength to withstand the pressure applied to the piling while the cutter blade 41 is being forced through the piling, and the size of the hinge and latch pins 31, 34 and 36 is not critical as long as they are of sufficient strength and diameter to withstand the maximum shearing forces the hydraulic rams are capable of producing.

Figure 7:
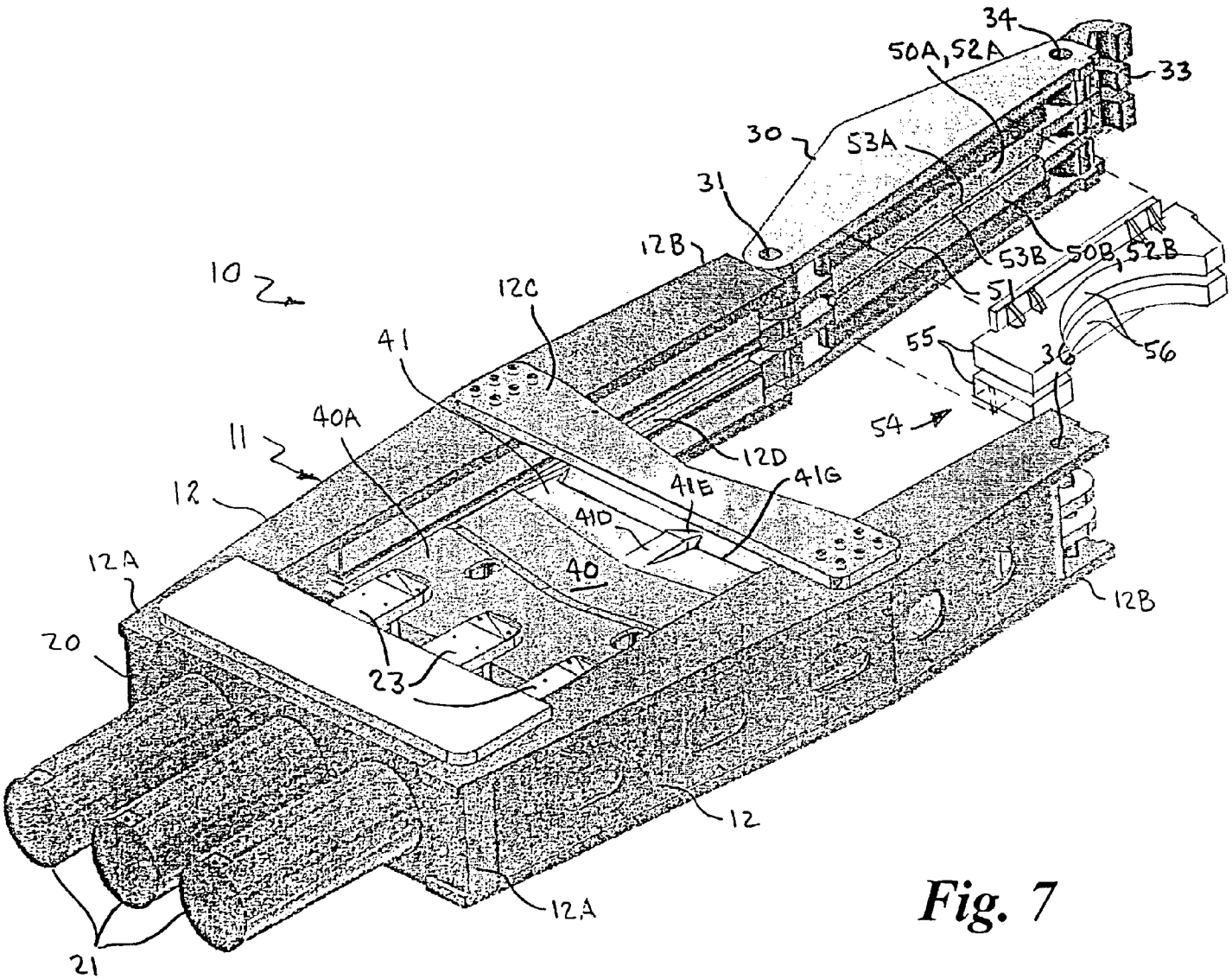
FIG. 7 is a perspective view of the apparatus similar FIG. 5 showing, somewhat schematically, a set of abutment adapter attachments for use with cylindrical piles, and the two-part cutter blade assembly carrying a blade having a straight leading edge and a penetrating tip.
Figure 8:
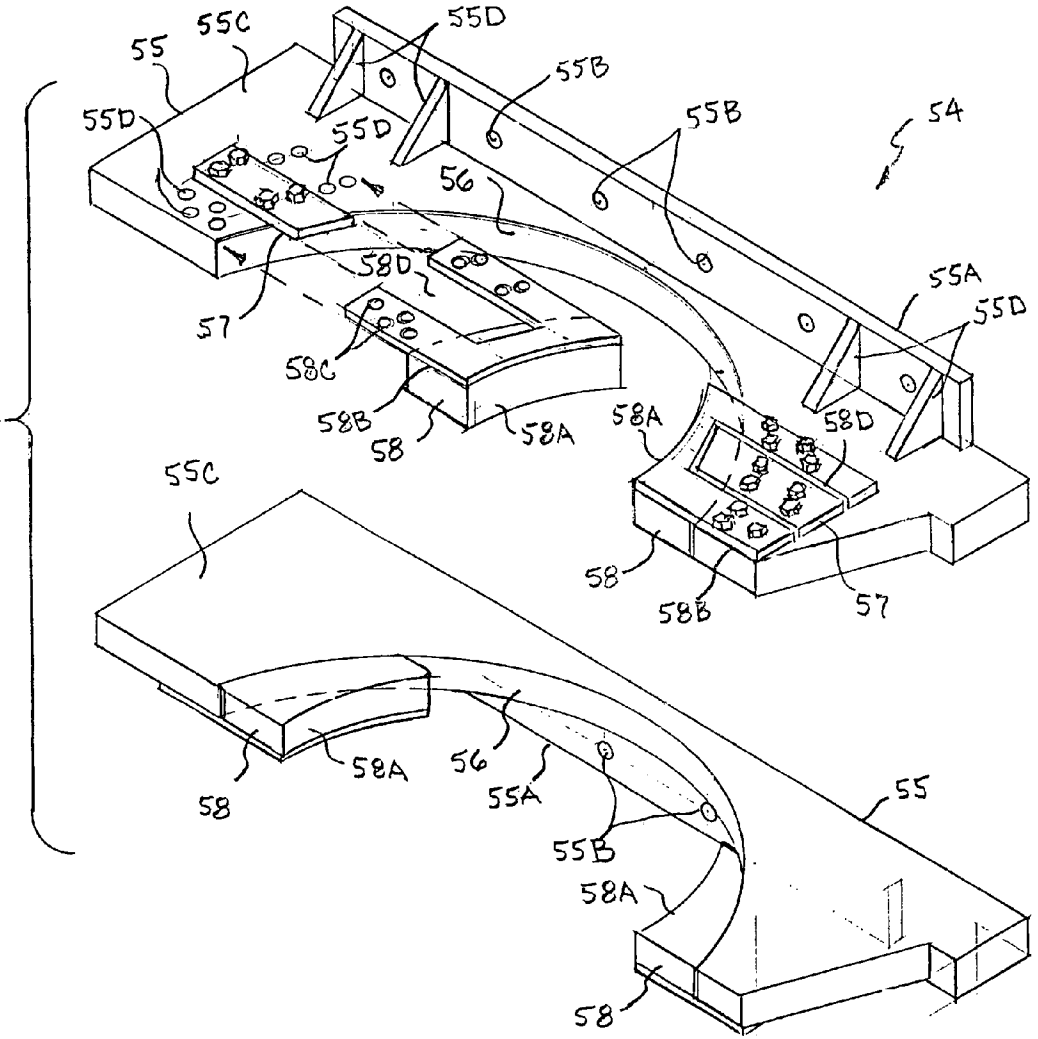
FIG. 8 is an isometric view of the set of abutment adapter attachments for use with cylindrical piles, and with a set of size adapters installed thereon.

The present apparatus may also be used to shear metal piles that are used to anchor or support offshore platforms, and the casing and conductor pipe arrangements, including conductor arrangements composed of several concentric sleeved pipes of increasing diameters with the annulus between adjacent ones of the pipes filled with grout or reinforcing cementation, when the platform is to be decommissioned. This operation utilizes the same apparatus including the same frame and cutter blade arrangement as described above with the addition of a set of removable abutment adapter attachments 54, as shown in FIGS. 7 and 8.

As shown somewhat schematically in FIG. 7 and in greater detail in FIG. 8, the set of abutment adapter attachments 54 comprise a pair of generally L-shaped members 55 that are removably mounted on the abutment 30 gate by bolts (not shown) in vertically opposed spaced relation above and below the opening 51 between the vertically spaced shearing blades 50A and 50B. Each L-shaped member 55 has a generally rectangular vertical portion 55A provided with bolt holes 55B which is bolted to the abutment gate 30, and a horizontal portion 55C that extends perpendicularly outward therefrom and is reinforced by diagonal gussets 55D secured therebetween. The horizontal portion 55C has a central concave arcuate recess 56 with a radius of curvature sized to receive larger diameter pile, casing and conductor pipe, for example a 36" diameter casing. A plurality of threaded bores 55D are formed in the horizontal portion 55A at each side of the arcuate recess 56 near its outer end for mounting sets of interchangeable size adapter inserts (as described below).

To adapt the apparatus to accommodate smaller sizes of casing or pipe, a generally rectangular tongue 57 may be removably bolted at each side of the arcuate recess 56 to the top surface of the upper horizontal portion 55C of the upper member and the bottom surface of the horizontal portion 55C of the lower member, with the laterally facing ends of the tongues extending a short distance into the recess 56. Several sets of interchangeable inserts 58 are provided, each having a concave curved side 58A and a laterally extending mounting flange 58B with bolt holes 58C formed therein. Each mounting flange 58B has an inwardly extending generally rectangular slot 58D. Each insert 58 is installed by placing its mounting flange 58B onto the horizontal portion 55C of the respective L-shaped member 55 with its slot 58D straddling a respective tongue 57, and bolting it to the horizontal portion. In the installed condition, the curved sides 58A of the inserts 58 are disposed inwardly in the larger recess 56 facing in laterally opposed relation.

The curved sides 58A of each set of inserts have a radius of curvature to receive successively smaller diameter casing and pipe, for example diameters of 30", 24", etc., and thus, the abutment adapter attachments 54 allow the shearing apparatus to accommodate various diameters of metal piles, casing and conductor pipe arrangements. It should be understood, that the abutment adapter attachments 54 may also be used for accommodating cylindrical concrete piles.

Although the central concave arcuate recess 56 of the L-shaped members 55 of the adapter attachments 54 have been shown, for purposes of example, as a concave arcuate recess, it should be understood that the concave recess 56 may be a V-shaped concave recess to receive piles of various diameters and tubing, and may have a beveled front edge. It should also be understood, that a single adapter attachment L-shaped member 55 having a concave V-shaped concave recess may be used to receive and shear smaller diameter pipe or tubing.

The present apparatus may also be used to crush the concrete matrix surrounding the reinforcing steel strands in reinforced concrete piles to expose the steel reinforcing within, without damaging the integrity of the structural steel within the pile so that it may be used to anchor additional structures. This operation utilizes the same apparatus including the same frame and cutter blade arrangement as described above with the addition of a set of removable crushing attachments.

Figure 9:
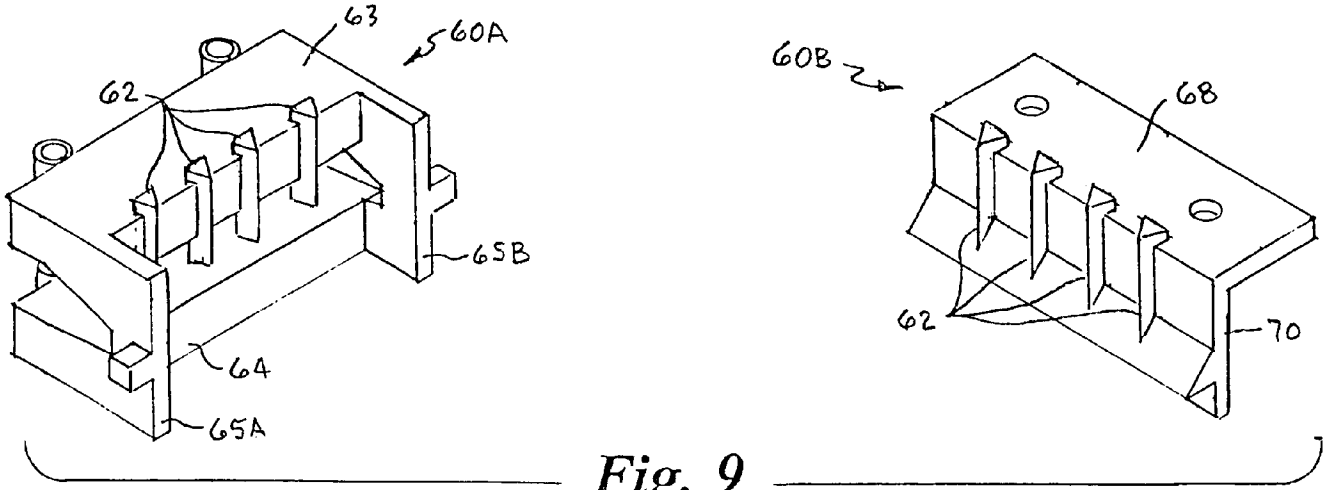
FIG. 9 is a perspective view of the movable crushing attachment and the stationary crushing attachment that are used to carry out the reinforced concrete pile crushing operation.
Figure 10:
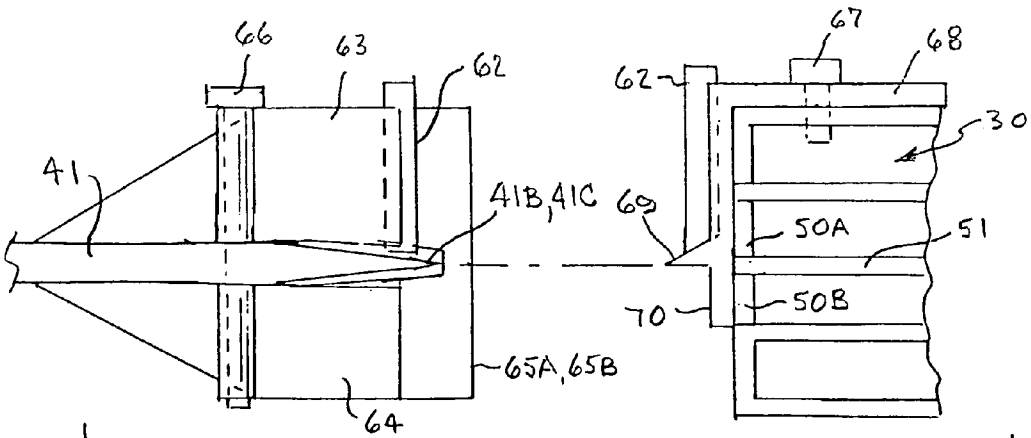
FIG. 10 is a somewhat schematic side elevation view of the movable crushing attachment and the stationary crushing attachment shown attached to the cutter blade and the abutment gate.

As shown somewhat schematically in FIGS. 9 and 10, the crushing attachments comprise a first movable crusher attachment 60A that is removably mounted to the front top and bottom surfaces of the cutter blade 41 by pins 66 and encompasses the front top and bottom surfaces of the cutter blade, and a second stationary abutment crusher attachment 60B that is removably mounted on the abutment gate 30 by holding pins 67 in opposed relation to the movable crusher attachment.

The movable crusher attachment 60A has a generally rectangular upper support member 63 and a generally rectangular lower abutment member 64 which are joined together at their outer ends in horizontal vertically spaced relation by lateral support segments 65A and 65B forming a frame with a rectangular open area between the upper support member, the lower abutment member and the lateral support segments. A series of replaceable vertical crusher elements 62 are removably mounted in the front face of the upper support member 63 in parallel laterally spaced relation just above the top of the open area and protrude a short distance outwardly from the front face of the upper support member. The flat front face of the lower abutment member 64 is spaced a short distance rearward relative to the vertical crusher elements 62 to serve as an abutment surface.

The open area of the movable crusher attachment 60A is configured to accommodate the front top and bottom surfaces of the cutter blade 41, and permit the central portion of the leading edge 41B or 41C of the cutter blade to extend a predetermined distance beyond the vertical crusher elements 62 and the flat front face of the lower abutment member 64 to allow the cutter blade to initially fracture the piling during the crushing process, as described hereinafter.

The spacing of the flat front face of the lower abutment member 64 relative to the leading edge 41B or 41C of the cutter blade 41 and the crusher elements 62 allow the cutter blade to initially fracture the piling and to limit the forward motion of the movable crusher assembly 60A upon completion of the crushing process such that the blade does not make contact with the structural steel reinforcing imbedded within the piling.

The stationary abutment crusher attachment 60B has a horizontal top portion 68 and a generally rectangular vertical front portion 70 that extends downwardly therefrom to serve as an abutment surface and has a fracturing blade 69 extending across the front portion near its bottom end. The horizontal top portion 68 is pinned to the top of the abutment gate 30 and its vertical front portion 70 extends downwardly to cover the opening 51 between the vertically spaced shearing blades 50A and 50B. The fracturing blade 69 protrudes outwardly a distance from the vertical front portion 70 and is disposed in a horizontal plane even with the horizontal plane of the leading edge 41B or 41C of the cutter blade 41. A series of replaceable vertical crusher elements 62 are removably mounted in the front face of the vertical front portion 70 of the stationary abutment crusher attachment 60B in parallel laterally spaced relation just above the top of the fracturing blade 69. The outer edge of the fracturing blade 69 extends a short distance beyond the vertical crusher elements 62. The opposed crusher elements 62 of the stationary crusher attachment 60B and the movable crusher attachment 60A may be disposed in opposed facing relation in substantially the same plane, or may be disposed in laterally offset planes.

OPERATION

In cutting or shearing metal piles, casing and conductor pipe arrangements, the cutter blade 41 is positioned on one side of the pile at the selected height and oriented transversely of the pile, and the abutment gate 30 with the abutment adapter attachments 54 installed above and below the opening 51 between the vertically spaced shearing blades 50A and 50B, and the curved recesses 56, (and curved surfaces of the adapters 58 if used) engaging the pile. The hydraulic rams 21 drive the cutter blade 41 forward from one side while the pile is supported by the curved recesses 56 on the opposite side until the penetrating tip 41E penetrates the side wall of the cylindrical pile, and continues with the angled leading edge or cutting edge 41F or 41G severing the pile. Just prior to the completion of the cutting stroke, the penetrating tip 41E and cutting blade leading edge 41F or 41G will enter the opening 51 between the horizontal vertically spaced shearing surfaces 53A and 53B of the shearing blades 52A and 52B in the abutment gate 30.

In cutting or shearing reinforced concrete piles, the cutter blade 41 is positioned on one side of the pile at the selected height and oriented transversely of the pile, and the abutment gate 30 is positioned at the opposite side of the pile from the cutter blade 41, with the vertically spaced abutment faces 52A and 52B above and below the opening 51 engaging the pile. The hydraulic rams 21 drive the cutter blade 41 forward from one side while it is supported by the abutment faces 52A, 52B, on the opposite side until it comes into contact with the pile surface.

At this point the leading edge 41B or 41C of the cutter blade penetrates the pile creating a transverse fracture through the concrete matrix. Continued advancement of the cutting blade through the pile will sever much of the reinforcing steel imbedded therein. Just prior to the completion of the cutting stroke, the cutting blade leading edge 41B or 41C will enter the opening 51 between the horizontal vertically spaced shearing surfaces 53A and 53B of the shearing blades 50A and 50B in the abutment gate 30. The close clearance of the movable cutter blade 41 to the stationary shearing surfaces cuts any remaining structural steel strands or rebar, to complete the shearing operation. Alternatively, when shearing cylindrical reinforced concrete piles, the abutment adapter attachments 54 may be installed, in which case the pile would be engaged on the curved recesses 56.

In the crushing operation, the movable crushing attachment 60A is removably mounted on the apparatus 10, such that its upper support member 63 and lower abutment member 64 are positioned on the front top and bottom surfaces of the cutter blade 41 with the flat abutment surface of the lower member 64 spaced a sufficient distance from the cutting edge 41B or 41C of the cutter blade to prevent the blade from engaging the reinforcing strands embedded in the concrete matrix. The stationary abutment crusher attachment 60B is removably mounted on the abutment gate 30 with its vertical front portion 70 covering the opening 51 between the vertically spaced shearing blades 50A and 50B in the gate.

The cutter blade 41 is positioned on one side of the pile at the selected height and oriented transversely of the pile with fracturing blade 69 of the stationary abutment crusher attachment 60B engaging the pile at the side opposite from the cutter blade. The hydraulic rams 21 drive the cutter blade 41 partially into the pile from one side such that its cutting edge 41B or 41C scores the pile, creating a horizontal fracture in the piling, while at the same time, the fracturing blade 69 positioned opposite the cutter blade creates an opposing fracture, thereby fracturing or cracking the concrete matrix of the pile without touching the reinforcing strands. Advancement of the cutter blade continues until the opposed vertical crusher elements 68 and flat abutment surfaces on the upper portions of the crusher attachments engage the pile and crush the concrete matrix above the cutter blade 40 and fracturing blade 69 such that it can be removed. At this point the flat front abutment face 70 of the lower abutment member 64 beneath the cutter blade will make contact with the uncrushed portion of the piling, thus preventing the cutter blade from advancing farther and preventing the cutter blade 41 and fracturing blade 69 from making contact with the structural reinforcing within the piling. Thus, the reinforcing strands are exposed without damaging the integrity of the structural steel within the pile.

Although the present invention has been described as having utility for shearing and crushing reinforced concrete piles, and shearing metal piles, well casing, tubing and conductor pipe arrangements, it should be understood that it may be used for shearing many other types of columnar members, such as trees and poles.

While this invention has been described fully and completely with special emphasis upon preferred embodiments, it should be understood that within the scope of the appended claims the invention may be practiced otherwise than as specifically described herein.

The invention claimed is:

1. An apparatus operable for shearing a concrete or metal pile member, comprising:

frame means having laterally opposed sides, a first end, and a second end defining a first open portion for receiving the member to be sheared;

an abutment gate pivotally mounted at said second end, a hydraulic ram connected with said gate for pivoting said gate relative to said first open portion between an open position to allow said first open portion to be moved laterally onto the member and a closed position to enclose the member, first and second abutment surfaces on said gate disposed in parallel vertically spaced relation for abutting the member, latch means connected with said gate and said frame means for releasably engaging said gate with said frame means, and a hydraulic ram connected with said latch means for moving it between an unlatched position to allow pivoting of said gate and a latched position to lock said gate in its said closed position;

a blade carrier movably mounted on said frame means and operable for being moved between a retracted position and an extended position traversing said first open portion, and a replaceable cutter blade removably connected with said blade carrier having a cutting edge designed to be pushed through said member when said blade carrier is moved from its retracted position to its extended position;

a first and a second stationary shearing blade on said gate disposed horizontally in parallel vertically spaced relation having opposed facing horizontal surfaces defining first and second vertically spaced horizontal shearing surfaces disposed in respective horizontal planes above and below the planes of a top surface and a bottom surface of said cutter blade and forming upper and lower perimeters of a second open portion into which said cutter blade passes when said blade carrier is moved to its extended position; and hydraulic rams connected with said blade carrier operable for moving said blade carrier from its retracted position to its extended position, and pushing said blade cutting edge through said member and through said first and second horizontal shearing surfaces into said second open portion, thereby shearing said member.

2. The apparatus according to claim 1, wherein said blade cutting edge is a concave edge.

3. The apparatus according to claim 1, further comprising: said blade cutting edge is a straight edge.

4. The apparatus according to claim 1, further comprising: a central piercing element on said cutter blade having a wedge-shaped tapered front end extending a distance forward of said cutting edge for penetrating the side wall of the member.

5. The apparatus according to claim 1, further comprising: a recessed area on at least one of a top or a bottom surface of said cutter blade disposed rearwardly of said cutting edge to reduce the surface area in contact with the material being sheared and thereby reduce frictional engagement therebetween as the blade passes through the member.

6. The apparatus according to claim 1, further comprising: a first and a second abutment adapter removably mounted on said abutment gate having respective outwardly extending horizontal portions disposed in opposed vertically spaced relation above and below said second open portion and above and below top and bottom surfaces of said cutter blade, said horizontal portions having concave arcuate abutment surfaces with a radius of curvature configured to abut a circumferential segment of a generally cylindrical member.

7. The apparatus according to claim 6, further comprising: a first pair and a second pair of adapter inserts removably mounted on said first and second abutment adapter, respectively, each pair having concave curved side segments disposed a distance inwardly of said concave arcuate abutment surface and facing in laterally opposed relation, and said curved side segments of each pair of inserts having a radius of curvature smaller than said concave arcuate abutment surface to receive a smaller diameter generally cylindrical member.

8. The apparatus according to claim 1, further comprising: an abutment adapter removably mounted on said abutment gate having an outwardly extending horizontal portion disposed in a horizontal plane above said second open portion and above a top surface of said cutter blade, said horizontal portion having a concave abutment surface with a radius of curvature configured to abut a circumferential segment of a generally cylindrical member.

9. An apparatus operable for shearing a reinforced concrete pile having a concrete matrix and elongate reinforcing strands embedded therein, said apparatus comprising:

frame means having laterally opposed sides, a first end, and a second end defining a first open portion for receiving the pile to be sheared;

an abutment gate pivotally mounted at said second end, a hydraulic ram connected with said gate for pivoting said gate relative to said first open portion between an open position to allow said first open portion to be moved laterally onto the pile and a closed position to enclose the pile, first and second abutment surfaces on said gate disposed in parallel vertically spaced relation for abutting the pile, latch means connected with said gate and said frame means for releasably engaging said gate with said frame means, and a hydraulic ram connected with said latch means for moving it between an unlatched position to allow pivoting of said gate and a latched position to lock said gate in its said closed position;

a blade carrier movably mounted on said frame means and operable for being moved between a retracted position and an extended position traversing said first open portion, and a replaceable cutter blade removably connected with said blade carrier having a cutting edge designed to be pushed through said pile when said blade carrier is moved from its retracted position to its extended position;

a first and a second stationary shearing blade on said gate disposed in parallel vertically spaced relation having opposed facing horizontal surfaces defining first and second vertically spaced horizontal shearing surfaces disposed in respective horizontal planes above and below the planes of a top surface and a bottom surface of said cutter blade and forming upper and lower perimeters of a second open portion into which said cutter blade passes when said blade carrier is moved to its extended position; and hydraulic rams connected with said blade carrier operable for moving said blade carrier from its retracted position to its extended position, and pushing said blade cutting edge through said pile and through said first and second horizontal shearing surfaces into said second open portion;

said cutter blade being driven entirely through the pile to crack the concrete matrix and sever reinforcing strands therein and into said second open portion to sever any remaining reinforcement strands.

10. An apparatus operable for crushing a reinforced concrete pile having a concrete matrix and elongate reinforcing strands embedded therein and selectively shearing the reinforcing strands, said apparatus comprising:

frame means having a first open portion for receiving the pile to be crushed;

cutting blade means for use in shearing the reinforcing strands, said cutting blade means movably mounted on said frame means and operable for being moved between a retracted position and an extended position traversing said first open portion and including a cutting edge designed to be pushed through the reinforcing strands when said cutting blade means is moved from its retracted position to its extended position;

said frame means having a second open portion into which said cutting blade passes after the blade has traversed said first open portion and said blade is in its extended position;

drive means operable for moving said cutting blade means from its retracted position, through said pile, and to its extended position;

a first crusher attachment adapted to be removably mounted on said blade, said first crusher attachment having an upper abutment surface disposed on a top surface of said blade and a lower abutment surface disposed on a bottom surface thereof when mounted thereon, each disposed a distance rearward of said blade cutting edge to control the depth of its penetration to prevent it from touching the reinforcing strands embedded therein, said upper abutment surface having protruding crusher elements; and a second crusher attachment adapted to be removably mounted on said frame means second end, said second crusher attachment having an upper abutment surface with protruding crusher elements, a lower abutment surface covering said second open portion, and a transverse fracturing blade edge disposed in substantially the same plane as said cutting edge of said cutting means blade extending a distance outwardly from said abutment surfaces adapted to engage one side of the pile received in said first open portion, said upper and lower abutment surfaces disposed in substantially the same planes as said first crusher attachment upper and lower abutment surfaces, respectively and disposed a distance rearward of said fracturing blade edge to control the depth of its penetration to prevent it from touching the embedded reinforcing strands;

in a crushing operation, said first crusher attachment is mounted on said cutting means blade and said second crusher attachment is mounted on said frame means second end, said cutting means is moved from its retracted position to its extended position, said cutting edge of said cutting means blade and said fracturing blade edge score and fracture the concrete matrix of the pile above the blade edges without touching the reinforcing strands embedded therein, said upper abutment surfaces and their crusher elements crush the fractured concrete matrix above the blade edges, and said lower abutment surfaces engage opposed sides of the pile below the blade edges to prevent further penetration of said blade edges, thereby crushing the concrete matrix above the blade edges to expose the reinforcing strands without damaging the structural integrity of the reinforcing strands; and in a shearing operation, said first crusher attachment is removed from said cutting means blade and said second crusher attachment is removed from said frame means second end, said cutting blade means is driven entirely through the pile to crack the concrete matrix and sever the reinforcing strands embedded therein and into said second open portion at said second end to sever any remaining reinforcement strands.

11. An apparatus operable for shearing a columnar member and the like, said apparatus comprising:

frame means having a first open portion for receiving the member to be sheared;

cutting means movably mounted on said frame means and operable for being moved between a retracted position and an extended position traversing said first open portion, said cutting means comprising a blade defining a cutting edge designed to be pushed through said member when said cutting means is moved from its retracted position to its extended position;

said frame means having a second open portion into which said blade passes after the blade has traversed said first open portion and said blade is in its extended position;

drive means operable for moving said blade from its retracted position, through said member, and to its extended position;

said blade passing entirely through said member and into said second open portion when said blade is moved from its retracted position to its extended position, thereby shearing said member;

abutment means adjacent said second open portion having first and second concave abutment surfaces with a radius of curvature configured to abut a circumferential segment of a generally cylindrical member, and first and second flat horizontal shearing surfaces disposed in parallel vertically spaced relation above and below said second open portion, respectively, through which said blade cutting edge passes, said shearing surfaces disposed in respective horizontal planes above and below the planes of a top surface and a bottom surface of said blade; and a first pair and a second pair of adapter inserts removably mounted on said first and second abutment surfaces, respectively, each pair having concave curved side segments disposed a distance inwardly of said concave arcuate abutment surface and facing in laterally opposed relation, and said curved sides of each set of inserts having a radius of curvature smaller than said concave arcuate abutment surface to receive a smaller diameter generally cylindrical member.

12. An apparatus operable for shearing a columnar member and the like, said apparatus comprising:

frame means having a first open portion for receiving the member to be sheared;

a gate pivotally mounted at one end of said first open portion, a second open portion on said gate and latch means connected with said gate and said frame means for releasably engaging said gate with said frame means;

gate pivoting means connected with said gate for pivoting said gate relative to said first open portion between an open position to allow said first open portion to be moved laterally onto the member and a closed position to enclose the member, and latch moving means connected with said latch for moving it between an unlatched position to allow pivoting of said gate and a latched position to lock said gate in its said closed position;

cutting means movably mounted on said frame means and operable for being moved between a retracted position and an extended position traversing said first open portion, said cutting means comprising a blade defining a cutting edge designed to be pushed through said member and into said second open portion on said gate when said cutting means is moved from its retracted position to its extended position thereby shearing said member; and drive means operable for moving said blade from its retracted position, through said member, and to its extended position;

abutment means on said gate having first and second concave abutment surfaces with a radius of curvature configured to abut a circumferential segment of a generally cylindrical member, and first and second flat horizontal shearing surfaces disposed in parallel vertically spaced relation above and below said second open portion, respectively, through which said blade cutting edge passes, said shearing surfaces disposed in respective horizontal planes above and below the planes of a top surface and a bottom surface of said blade; and a first pair and a second pair of adapter inserts removably mounted on said first and second abutment surfaces, respectively, each pair having concave curved side segments disposed a distance inwardly of said concave arcuate abutment surface and facing in laterally opposed relation, and said curved sides of each set of inserts having a radius of curvature smaller than said concave arcuate abutment surface to receive a smaller diameter generally cylindrical member.

* * * * *